US011217403B2

(12) United States Patent
Kuo et al.

(10) Patent No.: US 11,217,403 B2
(45) Date of Patent: Jan. 4, 2022

(54) DOORBELL DEVICE

(71) Applicant: Chicony Electronics Co., Ltd., New Taipei (TW)

(72) Inventors: Lun-Hung Kuo, New Taipei (TW); Pei-Sheng Tsai, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/892,317

(22) Filed: Jun. 4, 2020

(65) Prior Publication Data

US 2021/0159032 A1 May 27, 2021

(30) Foreign Application Priority Data

Nov. 25, 2019 (TW) ..... 108142788

(51) Int. Cl.

| | |
|---|---|
| ***H01H 13/06*** | (2006.01) |
| ***H01H 13/14*** | (2006.01) |
| ***G08B 3/10*** | (2006.01) |
| ***H01H 13/50*** | (2006.01) |
| ***H01H 13/04*** | (2006.01) |

(52) U.S. Cl.

CPC ..... *H01H 13/14* (2013.01); *G08B 3/10* (2013.01); *H01H 13/04* (2013.01); *H01H 13/50* (2013.01)

(58) Field of Classification Search

CPC .... H01H 13/06; H01H 2223/002; H01H 9/04; H01H 13/86; H01H 13/063; H01H 21/08; H01H 19/06; H01H 13/14; H01H 13/04; H01H 13/02; H01H 13/20; H01H 13/704; H01H 13/84; H01H 13/88

See application file for complete search history.

(56) References Cited

U.S. PATENT DOCUMENTS

2010/0072050 A1* 3/2010 Kubota ..... E05B 83/16 200/341

2014/0144762 A1* 5/2014 Cheong ..... H01H 13/06 200/302.2

* cited by examiner

*Primary Examiner* — Ahmed M Saeed

(74) *Attorney, Agent, or Firm* — CKC & Partners Co., LLC

(57) ABSTRACT

A doorbell device including upper case, elastic component, and button module is provided. The upper case has an outer surface, first annular-holding surface disposed opposite to the outer surface, first opening and annular trench. The first annular-holding surface surrounds the first opening. The annular trench surrounds the first annular-holding surface. The elastic component has first fastening protrusion and flexible-carrier layer surrounded and connected by the first fastening protrusion. The button module has a second annular-holding surface, first bottom surface, and pressing surface disposed opposite to the first bottom surface. The first fastening protrusion is interference fit with the annular trench. The button module is disposed on the flexible-carrier layer. At least a part of the first bottom surface is facing the flexible-carrier layer. The button module surrounded by the second annular-holding surface corresponds to the first opening, and the second annular-holding surface is facing the first annular-holding surface.

14 Claims, 5 Drawing Sheets

DOORBELL DEVICE

CROSS-REFERENCE TO RELATED APPLICATION

This application claims priority to Taiwan Application Serial Number 108142788, filed Nov. 25, 2019, which is herein incorporated by reference in its entirety.

BACKGROUND

Field of Invention

The present invention relates to a switch. More particularly, the present invention relates to a doorbell device.

Description of Related Art

With the improvement of electronic sensing technology, sensors such as image sensors and infrared sensors have now been applied to doorbell devices to provide more comprehensive functions to observe relevant information of visitors, thereby further improving security.

However, when these sensors are provided, a waterproof function needs to be further improved to prevent moisture or rain from the outside affecting or causing damage to the sensors. On the other hand, while improving the waterproof function, it is necessary to avoid affecting the pressing feeling of the doorbell device. Therefore, how to make a doorbell device that can avoid water and provide a good pressing feeling and sensing function is still one of the problems that wanted to be improved in the art.

SUMMARY

The present disclosure relates in general to a doorbell device.

According to an embodiment of the present disclosure, a doorbell device includes an upper case, an elastic component, and a button module. The upper case includes an outer surface, a first annular-holding surface, a first opening, and an annular trench. The first annular-holding surface is disposed opposite to the outer surface, the first annular-holding surface surrounds the first opening, and the annular trench surrounds the first annular-holding surface and the first opening. The elastic component includes a first fastening protrusion, and a flexible-carrier layer. The first fastening protrusion connects and surrounds the flexible-carrier layer. The button module includes a second annular-holding surface, a pressing surface, and a first bottom surface. The pressing surface is disposed opposite to the first bottom surface. The first fastening protrusion of the elastic component is secured to the annular trench via an interference fit. The button module is disposed on the flexible-carrier layer of the elastic component, and at least a part of the first bottom surface is facing the flexible-carrier layer. Part of the button module surrounded by the second annular-holding surface corresponds to the first opening, and the second annular-holding surface of the button module is facing the first annular-holding surface of the upper case.

In an embodiment of the present disclosure, the doorbell device further comprises a switch. The first bottom surface of the button module is facing towards the switch. On a normal direction of an upper surface of the flexible-carrier layer, the second annular-holding surface of the button module overlaps with at least a part of the first annular-holding surface. The button module is disposed adjacent to the switch.

In an embodiment of the present disclosure, the flexible-carrier layer of the elastic component includes a first bottom opening, and an annular structure surrounding the first bottom opening. The first bottom surface of the button module connects the annular structure, and a position of the switch corresponds to the first bottom opening.

In an embodiment of the present disclosure, the button module includes an upper cover, a first carrier base, and a second carrier base. The upper cover includes the pressing surface, a protecting inner surface, and a protecting inner wall. The first carrier base includes an inner carrier surface, and the first bottom surface. The second carrier base includes the second annular-holding surface, and a second bottom opening. The protecting inner surface is disposed opposite to the pressing surface. The protecting inner wall surrounds the protecting inner surface, and the protecting inner wall of the upper cover surrounds the first carrier base. The protecting inner surface of the upper cover is spaced apart from the inner carrier surface of the first carrier base, and the inner carrier surface is disposed opposite to the first bottom surface. The first carrier base is disposed on the second carrier base. The second annular-holding surface surrounds the first carrier base, and part of the first bottom surface of the first carrier base is corresponded to the second bottom opening of the second carrier base.

In an embodiment of the present disclosure, an area surrounded by an inner edge of the second annular-holding surface of the second carrier base is smaller than another area surrounded by an inner edge of the first opening.

In an embodiment of the present disclosure, the button module includes a sealing ring. The first carrier base Includes a first outer sidewall, and a trench. The first outer sidewall faces towards the protecting inner wall, and the first outer sidewall surrounds the inner carrier surface. The trench is formed around the first outer sidewall, and the trench surrounds the inner carrier surface. The sealing ring is disposed in the trench, and the sealing ring is secured to the trench and the protecting inner wall of the upper cover via an interference fit.

In an embodiment of the present disclosure, the button module includes a sensor being disposed on the inner carrier surface of the first carrier base.

In an embodiment of the present disclosure, the sensor is adapted to receive a sensing light having a wavelength in a sensing spectrum. A material of the upper cover includes a light-transmitting material, and the light-transmitting material is adapted to transmit the light having the wavelength in the sensing spectrum.

In an embodiment of the present disclosure, the button module includes a first adhesive layer. The second carrier base includes an annular-carrier surface. The second annular-holding surface surrounds the annular-carrier surface, and the first adhesive layer connects the annular-carrier surface to part of the first bottom surface.

In an embodiment of the present disclosure, the first carrier base includes a raised structure, and the raised structure is disposed on the first bottom surface. The second carrier base includes an annular-carrier surface, and the annular-carrier surface surrounds the second bottom opening. The first carrier base is disposed on the annular-carrier surface, and the raised structure of the first carrier base corresponds to the second bottom opening.

In an embodiment of the present disclosure, the elastic component includes an elastic trench being disposed on the edge of the flexible-carrier layer.

In an embodiment of the present disclosure, the doorbell device further includes a circuit board. The elastic component is disposed between the upper case and the circuit board. The elastic component further includes a second fastening protrusion surrounding the flexible-carrier layer, and the second fastening protrusion protrudes in a direction opposite to the first fastening protrusion. The second fastening protrusion is secured to the circuit board via an interference fit.

In an embodiment of the present disclosure, the doorbell device further includes a second adhesive layer, and the second adhesive layer is disposed between the first fastening protrusion and the annular trench.

In an embodiment of the present disclosure, the elastic component includes an elastic sidewall, and the elastic sidewall connects the flexible-carrier layer to the first fastening protrusion.

As seen above, the doorbell device of the embodiment of the present disclosure includes a button module, and the elastic force of the elastic component can feedback the pressure when the button module is pressed. Also, the second annular-holding surface can push against the first annular-holding surface of the upper case, so that the button module can be located at a proper position in the upper case.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
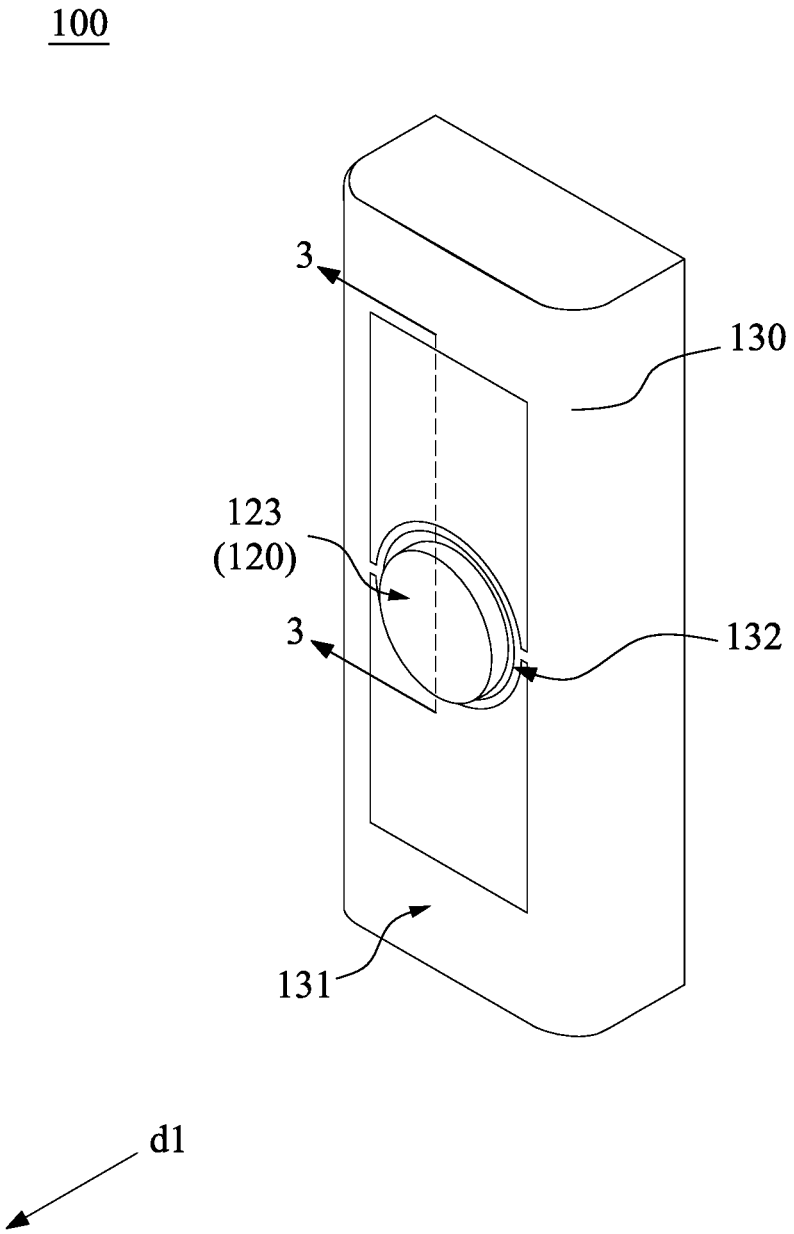
FIG. 1 is a schematic perspective view of a doorbell device of an embodiment of the present disclosure.

A doorbell device provided by the present disclosure can be applied to home or business, and the doorbell device can be set on the outside of the building for visitors, and provide sensing information and doorbell ringtones to users in the building.

Reference will now be made in detail to the present embodiments of the invention, examples of which are illustrated in the accompanying drawings. For the sake of clarity, practical details will also be explained in the following description. However, it should be understood that these practical details should not be used to limit the disclosure. That is, in some embodiments of the present disclosure, these practical details are unnecessary. In addition, in order to simplify the drawings, some conventional structures and elements will be shown in the drawings in a simple and schematic manner. Wherever possible, the same reference numbers are used in the drawings and the description to refer to the same or like parts.

FIG. 1 is a schematic perspective view of a doorbell device of an embodiment of the present disclosure. Please refer to FIG. 1. In the embodiment, the doorbell device 100 includes a button module 120 and an upper case 130. The upper case 130 includes an outer surface 131 and a first opening 132, and the button module 120 includes a pressing surface 123. Part of the button module 120 corresponds to the first opening 132. For example, part of the button module 120 of the embodiment passes through the first opening 132 along a direction d1, and the button module 120 provides the pressing surface 123 for the user to press.

Figure 2:
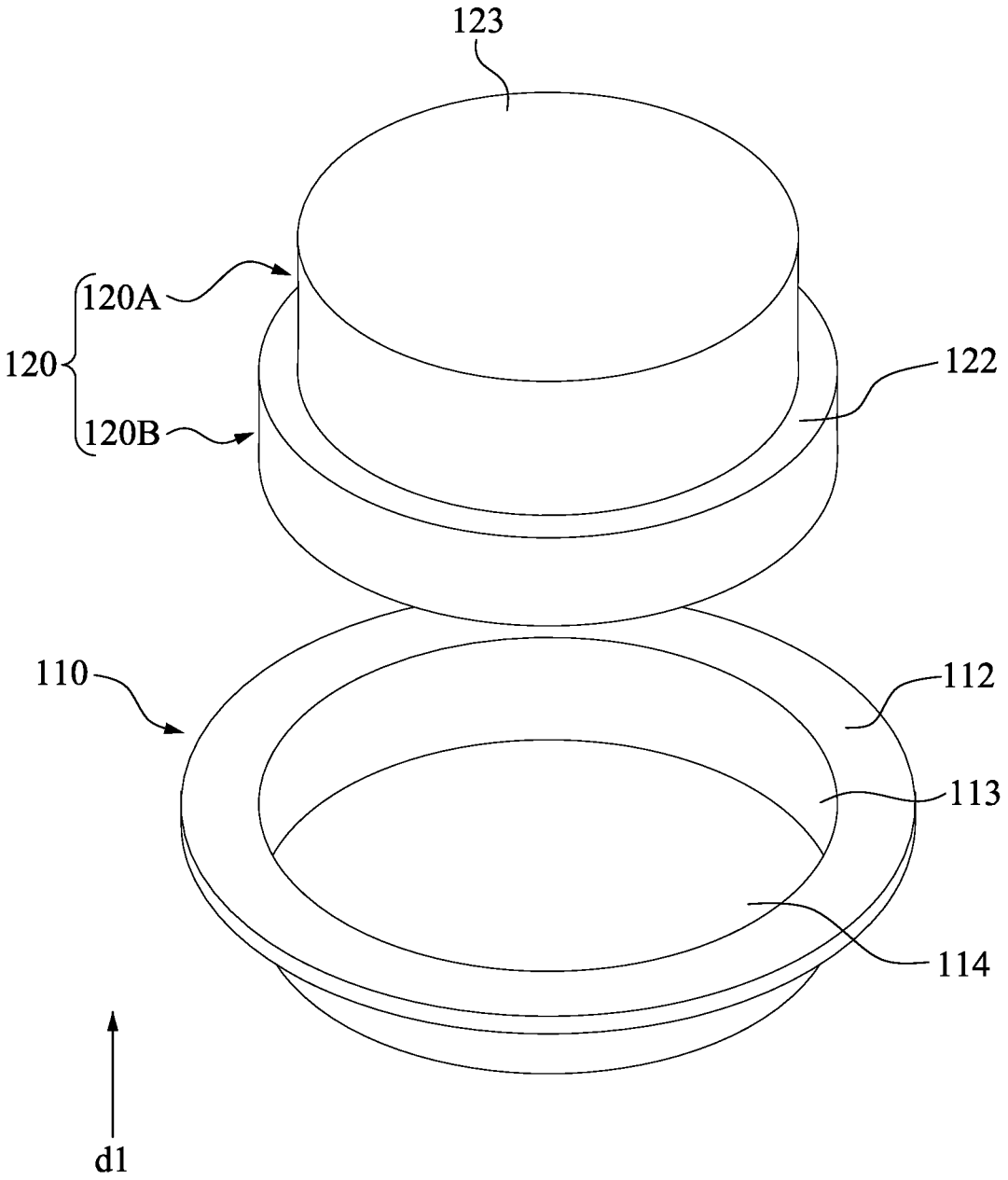
FIG. 2 is a schematic perspective exploded view of an elastic component and a button module in the doorbell device of the embodiment of the present disclosure.

FIG. 2 is a schematic perspective exploded view of an elastic component 110 and the button module 120 of the embodiment of the present disclosure. Please refer to FIG. 1 and FIG. 2. In the embodiment of the present disclosure, the doorbell device 100 includes an elastic component 110 and the button module 120. The elastic component 110 includes a first fastening protrusion 112 and a flexible-carrier layer 114 connected to each other. The button module 120 includes a second annular-holding surface 122, the pressing surface 123, and a first bottom surface 124B (not shown in FIG. 2, please refer to FIG. 3).

For example, a shape of the flexible-carrier layer 114 of the elastic component 110 is circular, and an inner edge of the first fastening protrusion 112 and an outer edge of the second annular-holding surface 122 are similar and circular, but the present disclosure is not limited thereto. In other embodiments, a shape of a flexible-carrier layer 114 of an elastic component 110 can be oval, rectangular, or polygonal, and an inner edge of a first fastening protrusion 112 and an outer edge of a second annular-holding surface 122 can be oval, rectangular, or polygonal, correspondingly.

Please refer to FIG. 2. In the embodiment, the flexible-carrier layer 114 has an elastic sidewall 113. The first fastening protrusion 112 of the elastic component 110 connects the flexible-carrier layer 114 through the elastic sidewall 113, and the first fastening protrusion 112 and the elastic sidewall 113 surround the flexible-carrier layer 114.

Furthermore, on a normal direction d1 of the upper surface of the flexible-carrier layer 114, a position of the first fastening protrusion 112 of the embodiment is higher than a position of flexible-carrier layer 114, and the elastic sidewall 113 connects the first fastening protrusion 112 and the flexible-carrier layer 114. A space formed by the elastic sidewall 113 and the flexible-carrier layer 114 can accommodate at least a part of the button module 120, but the disclosure is not limited thereto. In other embodiments, flexible-carrier layer 114 of the elastic component 110 can also directly connect to the first fastening protrusion 112, and the button module 120 can be directly disposed on a distribution area where the flexible-carrier layer 114 is located in the elastic component 110.

Please refer to FIG. 2. Moreover, in the embodiment, the button module 120 can be divided into a first part 120A and a second part 120B surrounding the first part 120A, wherein the pressing surface 123 is located in the first part 120A, and the second annular-holding surface 122 is located in the second part 120B of the button module 120. Compared to height of the position of the flexible-carrier layer 114, height of a position of the pressing surface 123 of the first part 120A in the normal direction d1 may be higher than height of the position of the second annular-holding surface 122 of the second part 120B in the normal direction d1. In other words, the first part 120A of the button module 120 includes an area of button module 120 covered by the pressing surface 123, and the second part 120B of the button module 120 includes an area of button module 120 covered by the second annular-holding surface 122. Also, on the direction d1, a distance between the flexible-carrier layer 114 and the pressing surface 123 is greater than a distance between the flexible-carrier layer 114 and the second annular-holding surface 122, but the disclosure is not limited thereto. In the embodiment, the height of the pressing surface 123 of the first part 120A is higher than the height of the second annular-holding surface 122. In other embodiment of the present disclosure, the height of the pressing surface 123 of the first part 120A and the height of the second annular-holding surface 122 may also be the same.

Please refer to both FIG. 1 and FIG. 2. In the doorbell device 100 of the embodiment, when facing towards the pressing surface 123, which is viewing the doorbell device 100 along the normal direction d1, the second annular-holding surface 122 located in the second part 120B of the button module 120 will be covered by the upper case 130, and the button module 120 in the first part 120A corresponds to the first opening 132 providing pressing for an user. The first fastening protrusion 112 of the elastic component 110 can be fixed to the upper case 130. The flexible-carrier layer 114 of the elastic component 110 may carry the button module 120, and the elastic component 110 can store and exert the restoring elastic force through shape changes such as stretching and contraction, so as to move the button module 120. The above components and connection will be further described below with reference to a sectional schematic view.

Figure 3:
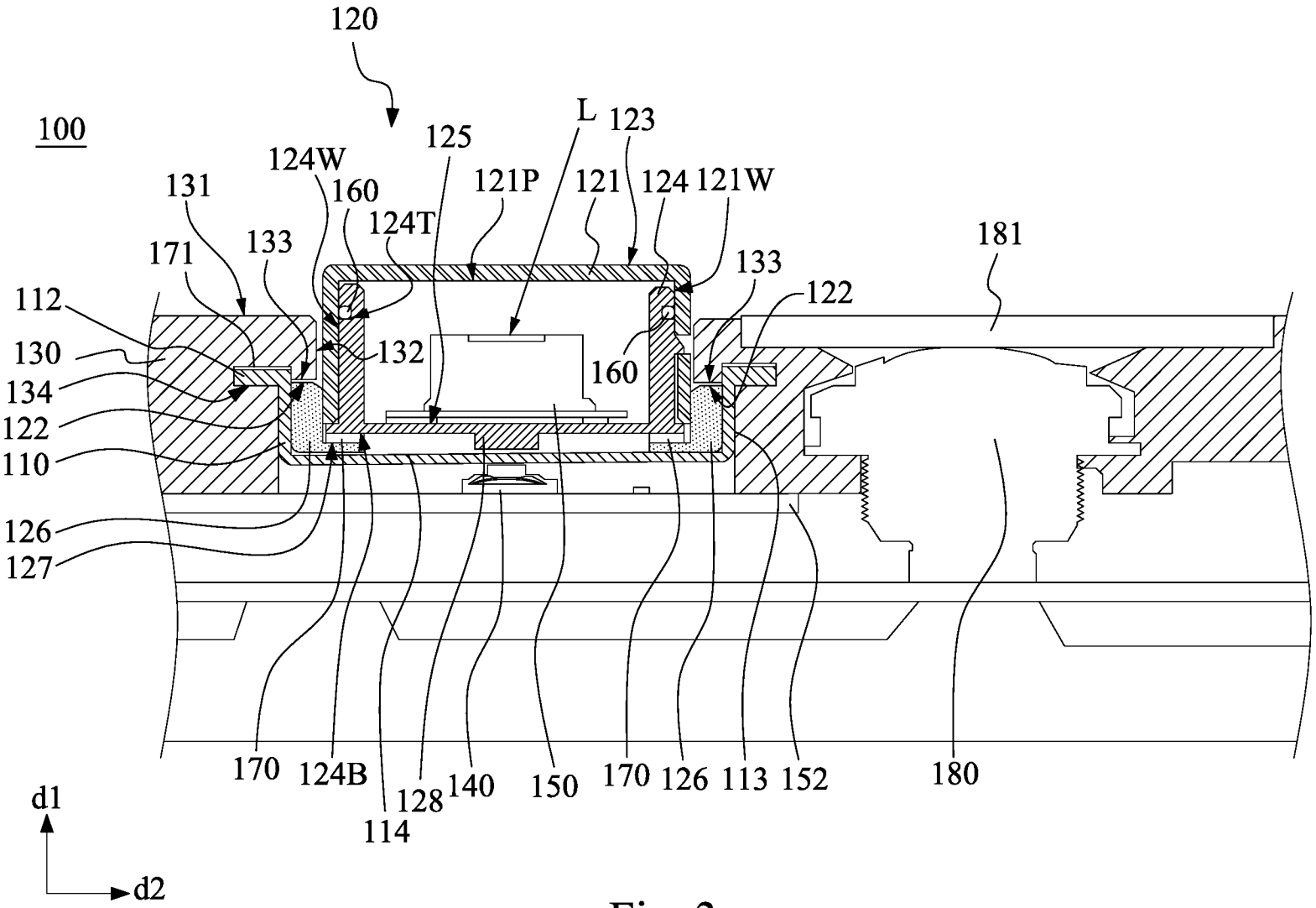
FIG. 3 is a schematic sectional view taken along the cutting plane line 3-3 in FIG. 1.

FIG. 3 is a sectional schematic view of part of the doorbell device 100 taken along a cutting plane line 3-3 in FIG. 1. Please refer to FIG. 3. In the embodiment, the upper case 130 has an outer surface 131, a first annular-holding surface 133, a first opening 132, and an annular trench 134. The first annular-holding surface 133 surrounds the first opening 132, and the annular trench 134 surrounds the first annular-holding surface 133 and the first opening 132.

In the figures referred to this embodiment, the first annular-holding surface 133 may be, for instance, part of the surface of the upper case 130 which is opposite to the outer surface 131, which is part of the surface of the upper case 130 facing towards an inside of the doorbell device 100. In the embodiment, the first annular-holding surface 133 may have a structure being able to fasten to other components, but the present disclosure is not limited thereto. In other embodiments, part of the first annular-holding surface 133 being adjacent to the first opening 132 can be a flat surface, and the annular trench 134 is formed around the first opening 132 and the first annular-holding surface 133, so as to fasten the elastic component 110.

Part of the button module 120 of the embodiment passes through the first opening 132 along the direction d1, and the annular trench 134 of the upper case 130 surrounds the first annular-holding surface 133 and the first opening 132, and, at a position of the annular trench 134, the annular trench 134 can be recessed in a direction d2 perpendicular to the direction d1. A shape of an inner wall of the annular trench 134 corresponds to a shape of outer contour of the first fastening protrusion 112. For instance, the shape can be annular, and the annular trench 134 can surround the first opening 132 at the same distance. The first fastening protrusion 112 of the elastic component 110 is inserted and secured to the annular trench 134 via an interference fit. A material of the elastic component 110 may include rubber, but the present disclosure is not limit thereto. In other embodiments, a material of the elastic component 110 may include other materials that are suitable for flexion and can provide elastic force or restoring force, that is, a shape and position of the elastic component 110 and a position of the button module 120 can be restored to a natural state when the elastic component 110 is free from directly or indirectly pressing by an external force.

It should be particularly noted that, in the drawings referred to here, in order to clearly illustrate the relative positions of various components, the deformation of some components that would occur after actual interference is not depicted, which is not intended to limit the present disclosure. Those with ordinary knowledge in the art should be able to easily know the actual assembly method of these components with reference to the drawings and the details in this specification.

Please refer to FIG. 3. The button module 120 is disposed on the flexible-carrier layer 114 of the elastic component 110, and the part of the button module 120 surrounded by the second annular-holding surface 122 corresponds to the first opening 132. The second annular-holding surface 122 is facing the first annular-holding surface 133, which is adjacent to the first opening 132 and surrounded by the annular trench 134.

Since the button module 120 is disposed on the flexible-carrier layer 114 of the elastic component 110, the elastic component 110 can be fasten to the annular trench 134 through the first fastening protrusion 112, so as to maintain the button module 120 at a proper position in the first opening 132. Meanwhile, the elasticity of the elastic component 110 can further provide a degree of freedom for button module 120 to move along the normal direction d1, so that the button module 120 of the doorbell device 100 can provide a good pressing experience.

Please refer to FIG. 3. The doorbell device 100 further includes a switch 140. The first bottom surface 124B of the button module 120 is facing towards the switch 140, and the second annular-holding surface 122 of the button module 120 and the first annular-holding surface 133 partially overlap each other on the normal direction d1. The button module 120 is disposed beside the switch 140. For example, the switch 140 of the embodiment is, for example, a push-button switch, and the switch 140 is disposed on the circuit board 152 and is spaced apart from the button module 120 by a distance. By pressing the button module 120, the button module 120 moves down and pushes the flexible-carrier layer 114 to deform the elastic component 110, and the elastic component 110 further presses the switch 140 to cause the switch 140 to send a doorbell signal. Then, since the elastic component 110 will also provide an elastic force to resist the pressing when deformed, when the pressing is released from the button module 120 and the elastic component 110 returns to a natural state, the button module 120 on the flexible-carrier layer 114 will also be pushed by the elastic force, and the button module 120 will be moved up to its original position. In other embodiments, the switch 140 disposed on the circuit board 152 may touch the button module 120. In other embodiments of the present disclosure, the switch 140 may also be disposed on the first bottom surface 124B of the button module 120 and is spaced apart from the circuit board 152 by a distance. In some embodiments, the switch 140 disposed on the first bottom surface 124B may touch the circuit board 152. In another embodiment of the present disclosure, the switch 140 may also be disposed on the flexible-carrier layer 114 and faces towards the circuit board 152.

Moreover, please refer to FIG. 3, since the second annular-holding surface 122 of the button module 120 is facing towards the first annular-holding surface 133 around the first opening 132, when the button module 120 is released from the pressing and then the button module 120 moves up, the second annular-holding surface 122 will push the first annular-holding surface 133 around the first opening 132, and the first annular-holding surface 133 can stop the movement of the button module 120. Therefore, the first annular-holding surface 133 of the upper case 130 can limit the position of the button module 120, so that the movement of the button module 120 can be maintained in an appropriate range.

For example, in the embodiment, the normal direction (i.e. the direction d1) of the first annular-holding surface 133 and the normal direction (i.e. the direction d1) of the second annular-holding surface 122 of the button module 120 are parallel, so the first annular-holding surface 133 is adapted to limit the movement of the button module 120 by contacting the second annular-holding surface 122.

To be specific, please refer to FIG. 3, the button module 120 of the embodiment includes an upper cover 121, a first carrier base 124, and a second carrier base 126. The upper cover 121 includes a pressing surface 123, a protecting inner surface 121P disposed opposite to the pressing surface 123, and a protecting inner wall 121W surrounding the protecting inner surface 121P. The first carrier base 124 includes an inner carrier surface 125 and a first bottom surface 124B. Furthermore, the first carrier base 124 may further include a raised structure 128 which is disposed on the first bottom surface 124B.

The protecting inner wall 121W of the upper cover 121 surrounds the first carrier base 124, and the protecting inner surface 121P of the upper cover 121 is spaced apart from the inner carrier surface 125 of the first carrier base 124 by a distance. In the embodiment, the second annular-holding surface 122 is located on the second carrier base 126, the first carrier base 124 is disposed on the second carrier base 126, and the second annular-holding surface 122 surrounds the first carrier base 124. The second annular-holding surface 122 is located around the first carrier base 124.

In other words, the upper cover 121 of this embodiment can be sleeved on the first carrier base 124, and a space is formed between the protecting inner surface 121P of the upper cover 121 and the inner carrier surface 125 of the first carrier base 124.

A material of the first carrier base 124 and the second carrier base 126 may include polycarbonate (PC), or acrylonitrile butadiene styrene (ABS).

Furthermore, the doorbell device 100 can further include a sensor 150. The sensor 150 is disposed on the inner carrier surface 125 of the first carrier base 124. Therefore, the sensor 150 can be disposed in the space between the protecting inner surface 121P and the inner carrier surface 125.

For example, the sensor 150 can be, for example, infrared sensor, and the infrared sensor can include passive infrared sensor, or pyroelectric infrared sensor (PIR sensor).

Moreover, in the embodiment, the doorbell device 100 can include, for example, an internal power electrically connected to the sensor 150 and wireless transmission module (not shown), so as to provide power and to transmit signal to other components in the doorbell device 100, but the present disclosure is not limit thereto. In other embodiments, the flexible-carrier layer 114 may also include an opening, which allows an electrical connection between the sensor 150 and the circuit board 152, and it will be further illustrated with the following other embodiments.

In the embodiment, the sensor 150 is adapted to receive a sensing light L having a wavelength in a sensing spectrum, and the sensing spectrum may include infrared spectrum. Also, a material of the upper cover 121 may include a light-transmissible material, and the light-transmissible material is adapted to transmit the light L having the wavelength in the sensing spectrum. For example, the light-transmissible material may include infrared penetrable plastic, which is suitable for transmitting light having a wavelength in the range of 0.76 to 400 micrometer, and the infrared penetrable plastic can include high density polyethylene (HDPE).

In other embodiments of the present disclosure, the sensor 150 may include radar sensor, and a material of the upper cover 121 may also include a material that is adapted to transmit radar signal emitted from the sensor 150, but the present disclosure is not limited thereto.

Please refer to FIG. 3. The button module 120 of the doorbell device 100 of the present disclosure may also include a sealing ring 160, and the first carrier base 124 includes a first outer sidewall 124W and a trench 124T. The first outer sidewall 124W is facing towards the protecting inner wall 121W and surrounds the inner carrier surface 125, the trench 124T is formed on the first outer sidewall 124W and surrounds the inner carrier surface 125, and the sealing ring 160 is disposed in the trench 124T. Sealing ring 160 is secured to the trench 124T of the first carrier base 124 and the protecting inner wall 121W of the upper cover 121 via an interference fit.

Therefore, the sealing ring 160 can further block external water and dust between the upper cover 121 and the first carrier base 124, thereby further protecting the components in the button module 120. For example, the sensor 150 dispose in the space formed by the upper cover 121 and the first carrier base 124 can be protected.

Furthermore, the button module 120 of the doorbell device 100 can further include a first adhesive layer 170. The first carrier base 124 includes a first bottom surface 124B, and the first bottom surface 124B is disposed opposite to the inner carrier surface 125 and facing towards the flexible-carrier layer 114 of the elastic component 110. The second carrier base 126 includes an annular-carrier surface 127, and the second annular-holding surface 122 surrounds the annular-carrier surface 127. The first adhesive layer 170 connects the annular-carrier surface 127 to part of the first bottom surface 124B, so as to provide a fixation between the first carrier base 124 and the second carrier base 126 and improving water and vapor blocking effect.

The doorbell device 100 can further includes a second adhesive layer 171, and the second adhesive layer 171 can be disposed between the first fastening protrusion 112 and at least an inner surface of the annular trench 134, so as to provide a fixation between the elastic component 110 and upper case 130 and improving the water and vapor blocking effect.

For example, the first adhesive layer 170 and the second adhesive layer 171 of the embodiment can be double-sided adhesive or waterproof adhesive, but the present disclosure is not limited thereto.

Moreover, in the embodiment, an area surrounded by an inner edge of the second annular-holding surface 122 of the second carrier base 126 is smaller than an area surrounded by an inner edge of the first opening 132. The periphery of the first carrier base 124 and the upper cover 121 disposed on the second carrier base 126 will be limited to a region by the second carrier base 126, and the cross-sectional area of this region will also be smaller than the area surrounded by the inner edge of the first opening 132, so the first carrier base 124 and the upper cover 121 exceeding the second annular-holding surface 122 can easily pass through the first opening 132. In other words, referring to FIG. 3, on a horizontal reference plane with a normal vector in the direction d1, the second carrier base 126 can define the shapes of the upper cover 121 and the first carrier base 124 so that the outer contours of the upper cover 121 and the first carrier base 124 do not exceed the inner edge of first opening 132. The inner edge of the first opening 132 prevents the button module 120 from stuck while the button module 120 is free from pressing.

The doorbell device 100 of the embodiment can further include an image capturing device 180 and a light-transmissive cover plate 181, so as to capture an image in front of the doorbell device 100.

Furthermore, since the button module 120 of the embodiment has a sensor 150, the image capturing device 180 may be notified to be temporarily turned off for energy saving when the sensor 150 senses that no one is in front of the doorbell device 100.

For example, while the sensor 150 is an infrared sensor, the sensing spectrum of the sensor 150 may include infrared spectrum. When nobody is approaching the front of the doorbell device 100, the sensor 150 detects no infrared from any human, i.e. no infrared having wavelength in the sensing spectrum is detected by the sensor 150, and thus the image capturing device 180 may temporarily be turned off for energy saving.

When the sensor 150 detects infrared of a human body, the image capturing device 180 can be automatically activated to allow the image capturing device 180 to capture an image through the light-transmissive cover plate 181. Therefore, the doorbell device 100 of this embodiment can provide an automatic sensing function, and can also reduce energy consumption.

Figure 4:
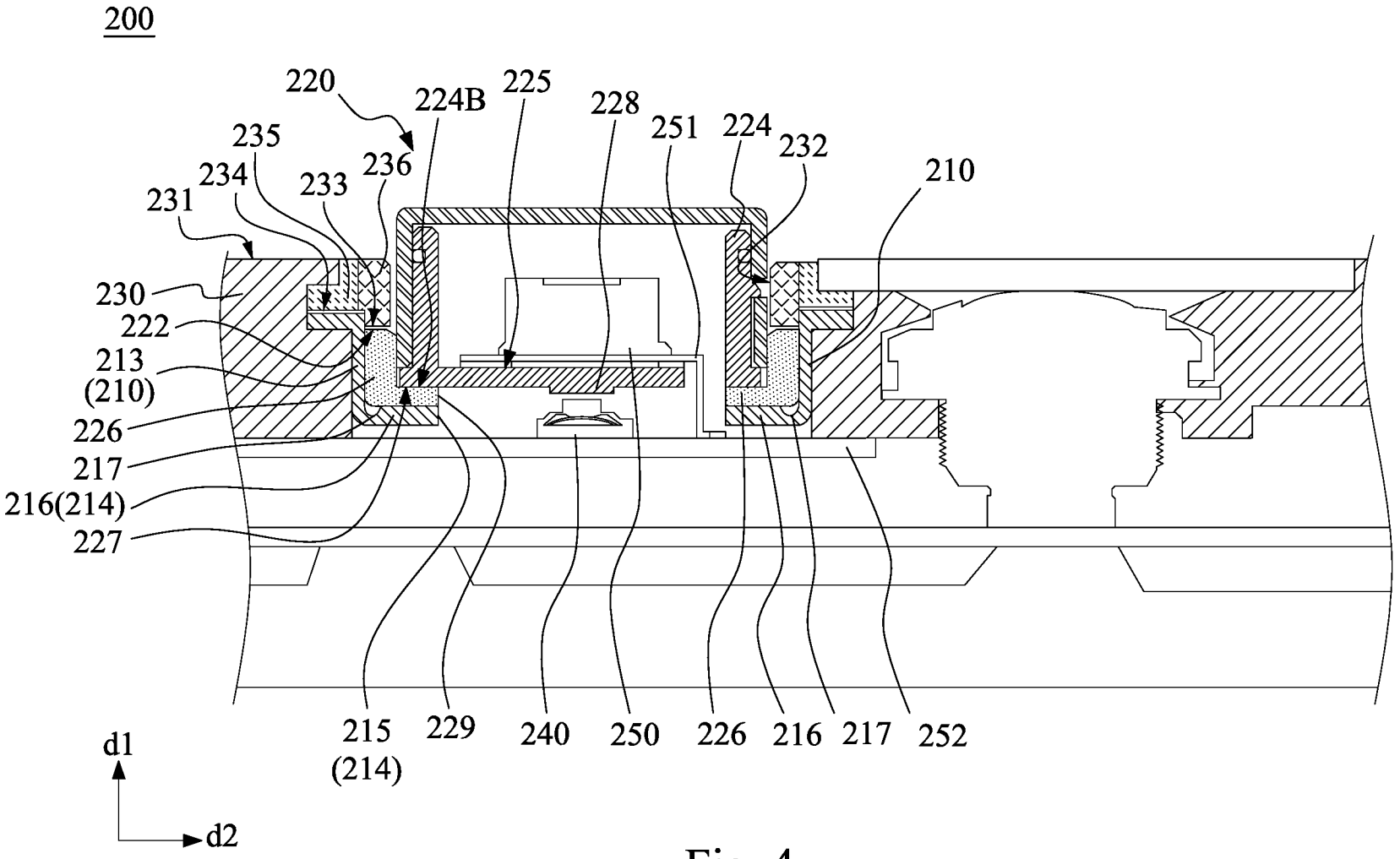
FIG. 4 is a schematic sectional view of a doorbell device of another embodiment of the present disclosure.

FIG. 4 is a sectional view of a doorbell device 200 of another embodiment of the present disclosure. Please refer to FIG. 4. The doorbell device 200 of the embodiment is similar to the doorbell device 100 mentioned above, and the detailed description of the features of the same components will not be described below.

The doorbell device 200 of the embodiment includes an upper case 230, an elastic component 210, and a button module 220. The difference from the above-mentioned doorbell device 100 is that a flexible-carrier layer 214 of the elastic component 210 in this embodiment includes a first bottom opening 215 and an annular structure 216. The annular structure 216 surrounds the first bottom opening 215. The button module 220 is disposed on the annular structure 216, and a position of a switch 240 corresponds to the first bottom opening 215.

The button module 220 can directly press the switch 240 through the first bottom opening 215 of the elastic component 210. Moreover, the doorbell device 200 may further include a flexible printed circuit board 251 connected to the sensor 250, and the flexible printed circuit board 251 can easily connect the circuit board 252 through the first bottom opening 215.

Moreover, the first carrier base 224 may have a raised structure 228 disposed on the first bottom surface 224B which is disposed opposite to the inner carrier surface 225. The second carrier base 226 includes an annular-carrier surface 227 and a second bottom opening 229. The annular-carrier surface 227 surrounds the second bottom opening 229. The first carrier base 224 is disposed on the annular-carrier surface 227, and the raised structure 228 of the first carrier base 224 can pass through the second bottom opening 229, so as to define a required moving distance of the button module 220 for pressing the switch 240.

Moreover, embodiments of the present disclosure are not limited to the implementation where the upper case 130 is integrally formed. Please refer to FIG. 4. The upper case 230 of the embodiment has an outer surface 231, a first opening 232, a first annular-holding surface 233, and an annular trench 234, and the upper case 230 may also have a first ring 235 and a second ring 236. The first ring 235 is configured to dispose the elastic component 210 in the upper case 230, and the second ring 236 is configured to dispose the button module 220 in the upper case 230. In other words, the first annular-holding surface 233 surrounded by the annular trench 234 in the upper case 230 of the embodiment is located at the second ring 236, and the second ring 236 can be made of light-transmissible material, so as to provide a better looking.

Therefore, in the embodiment, the first annular-holding surface 233 of the upper case 230 facing the second annular-holding surface 222 is located at the second ring 236, and the first ring 235 and another part of the upper case 230 form the annular trench 234 therebetween. In other embodiments of the present disclosure, material of the second ring 236, the first carrier base 224 and the elastic component 210 may all be light-transmissible material, and light can pass through an area adjacent to the button module 220, so as to provide a better looking.

In the embodiment, the elastic component 210 includes an elastic trench 217 being disposed on the edge of the flexible-carrier layer 214. The elastic trench 217 is beneficial for bending the flexible-carrier layer 214 relative to the elastic sidewall 213, so as to facilitate the movement of the button module 220. Meanwhile, the elastic component 210 of the embodiment can include elastic material with higher stiffness, and, due to the elastic trench 217, the button module 220 is moveable, and a stable fixing effect is provided.

Figure 5:
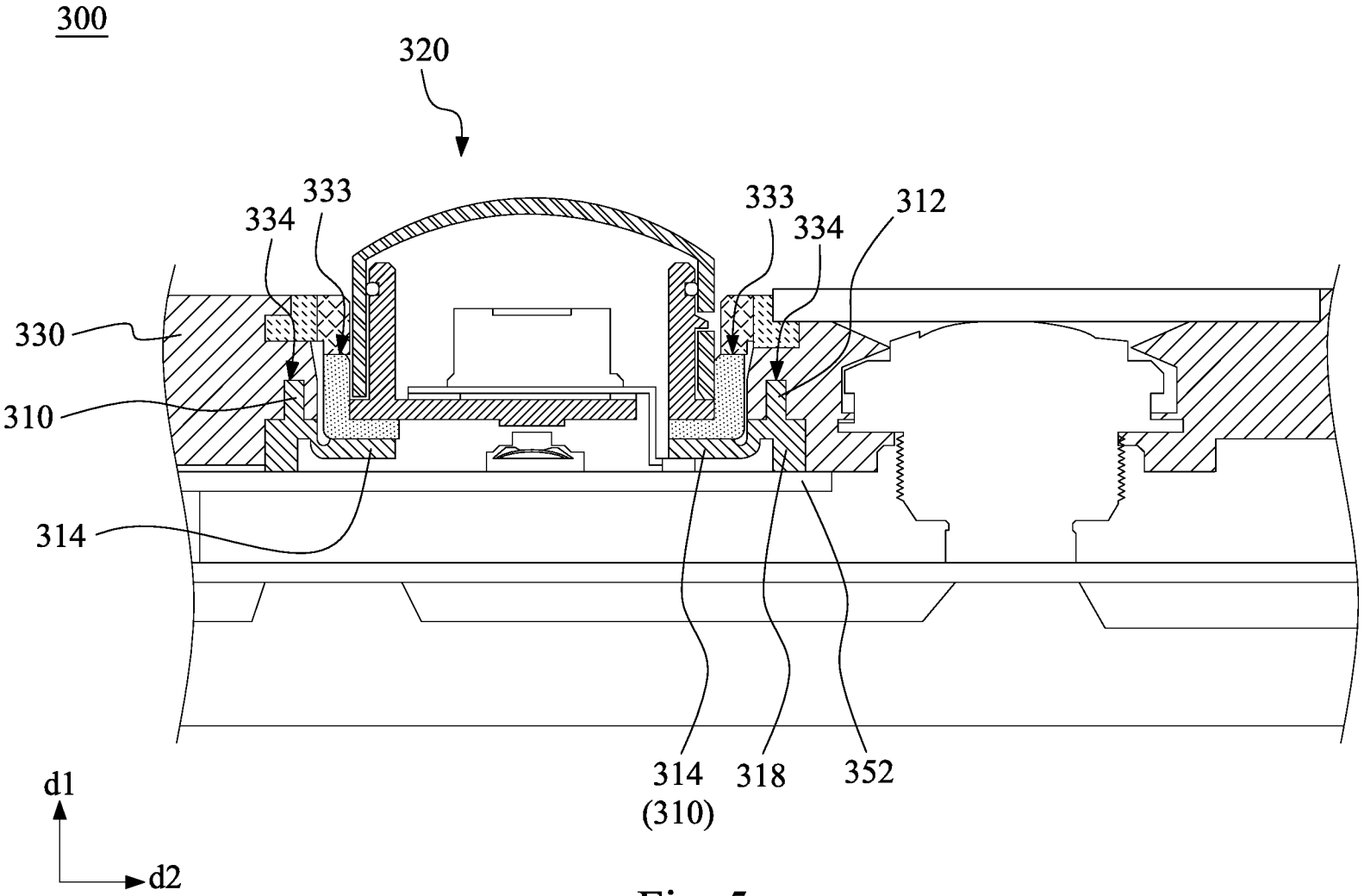
FIG. 5 is a schematic section view of a doorbell device of still another embodiment of the present disclosure.

FIG. 5 is a sectional view of a doorbell device 300 of still another embodiment of the present disclosure. Please refer to FIG. 5. The doorbell device 300 of this embodiment is similar to the above-mentioned doorbell devices 100, 200, and the detailed description of the features of the same components will not be described below.

In the embodiment, the doorbell device 300 includes an upper case 330, an elastic component 310 and a button module 320. The button module 320 is disposed on the elastic component 310, and the upper case 330 has a first annular-holding surface 333 being adapt to push the button module 320, wherein the pressing method of the first annular-holding surface 333 is similar to the doorbell device 100 of the above-mentioned embodiment, and thus the same description will not be described below. Please refer to FIG. 5. The annular trench 334 of the upper case 330 is recess in a direction d1, and the direction d1 is a normal direction of the flexible-carrier layer 314 while it's free from external force. In other words, the sidewall of the annular trench 334 extends along the normal direction d1 of the upper surface of the flexible-carrier layer 314 of the elastic component 310 towards the inside of the upper case 330. The doorbell device 300 further includes a circuit board 352. The button module 320 and the elastic component 310 are disposed between the upper case 330 and the circuit board 352.

The elastic component 310 of the embodiment includes a first fastening protrusion 312 and a second fastening protrusion 318, and the first fastening protrusion 312 and the second fastening protrusion 318 surround and connect the flexible-carrier layer 314. The first fastening protrusion 312 and the second fastening protrusion 318 are located between the annular trench 334 and the circuit board 352. The second fastening protrusion 318 projects in a direction opposite to the first fastening protrusion 312, and the second fastening protrusion 318 interferes with the circuit board 352. In other words, the second fastening protrusion 318 of the elastic component 310 in this embodiment is pressurized and disposed on the circuit board 352, and the first fastening protrusion 312 is disposed in the annular trench 334 of the upper case 330. On the direction d1, the upper case 330 and the circuit board 352 can clamp the first fastening protrusion 312 and the second fastening protrusion 318, so the elastic component 310 of the embodiment can be more stably disposed between the circuit board 352 and the upper case 330.

In summary, the doorbell device of an embodiment of the present disclosure includes a button module and an elastic component, and the upper case can fixedly carry the elastic component of the button module. The elastic force of the elastic component can provide a feedback while the button module is being pressed. In addition, with the disposition of the elastic component of the embodiment of the present disclosure, a friction and a rebound force caused by a spring force provided by a button module of a doorbell device through a spring can be improved, thereby providing a better button-pressing feel. At the same time, the second annular-holding surface can push the first annular-holding surface of the upper case, so as to control the moving range of the button module in the doorbell device, and the button module will be located at a proper position in the upper case.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A doorbell device, comprising:

an upper case comprising an outer surface, a first annular-holding surface, a first opening, and a annular trench, wherein the first annular-holding surface is disposed opposite to the outer surface, and the first annular-holding surface surrounds the first opening, and the annular trench surrounds the first annular-holding surface and the first opening;

an elastic component comprising a first fastening protrusion, and a flexible-carrier layer, wherein the first fastening protrusion connects and surrounds the flexible-carrier layer; and a button module comprising a second annular-holding surface, a pressing surface, and a first bottom surface, wherein the pressing surface is disposed opposite to the first bottom surface, wherein the first fastening protrusion of the elastic component is secured to the annular trench via an interference fit, and the button module is disposed on the flexible-carrier layer of the elastic component, and at least a part of the first bottom surface is facing the flexible-carrier layer, and part of the button module surrounded by the second annular-holding surface corresponds to the first opening, and the second annular-holding surface of the button module is facing the first annular-holding surface of the upper case, wherein the button module comprises:

an upper cover comprising the pressing surface, a protecting inner surface, and a protecting inner wall;

a first carrier base comprising an inner carrier surface, and the first bottom surface; and a second carrier base comprising the second annular-holding surface, and a second bottom opening, and the protecting inner surface is disposed opposite to the pressing surface, and the protecting inner wall surrounds the protecting inner surface, and the protecting inner wall of the upper cover surrounds the first carrier base, and the protecting inner surface of the upper cover is spaced apart from the inner carrier surface of the first carrier base, and the inner carrier surface is disposed opposite to the first bottom surface, and the first carrier base is disposed on the second carrier base, and the second annular-holding surface surrounds the first carrier base, and part of the first bottom surface of the first carrier base is corresponded to the second bottom opening of the second carrier base.

2. The doorbell device of claim 1 further comprising:

a switch, wherein the first bottom surface of the button module is facing towards the switch, and, on a normal direction of an upper surface of the flexible-carrier layer, the second annular-holding surface of the button module overlaps with at least a part of the first annular-holding surface, and the button module is disposed adjacent to the switch.

3. The doorbell device of claim 2, wherein the flexible-carrier layer of the elastic component comprises:

a first bottom opening; and an annular structure surrounding the first bottom opening, wherein the first bottom surface of the button module connects the annular structure, and a position of the switch corresponds to the first bottom opening.

4. The doorbell device of claim 1, wherein an area surrounded by an inner edge of the second annular-holding surface of the second carrier base is smaller than another area surrounded by an inner edge of the first opening.

5. The doorbell device of claim 1, wherein the button module comprises:

a sealing ring, and the first carrier base comprises:

a first outer sidewall facing towards the protecting inner wall and surrounding the inner carrier surface; and a trench forming around the first outer sidewall and surrounding the inner carrier surface, wherein the sealing ring is disposed in the trench, and the sealing ring is secured to the trench and the protecting inner wall of the upper cover via an interference fit.

6. The doorbell device of claim 1, wherein the button module comprises a sensor being disposed on the inner carrier surface of the first carrier base.

7. The doorbell device of claim 6, wherein the sensor is adapted to receive a sensing light having a wavelength in a sensing spectrum, and a material of the upper cover comprises a light-transmitting material, and the light-transmitting material is adapted to transmit the light having the wavelength in the sensing spectrum.

8. The doorbell device of claim 1, wherein the button module comprises:

a first adhesive layer, and the second carrier base comprises:

an annular-carrier surface, and the second annular-holding surface surrounds the annular-carrier surface, and the first adhesive layer connects the annular-carrier surface to part of the first bottom surface.

9. The doorbell device of claim 1, wherein the first carrier base comprises:

a raised structure being disposed on the first bottom surface, and the second carrier base comprises:

an annular-carrier surface surrounding the second bottom opening, and the first carrier base is disposed on the annular-carrier surface, and the raised structure of the first carrier base corresponds to the second bottom opening.

10. The doorbell device of claim 1, wherein the elastic component comprises an elastic trench being disposed on an edge of the flexible-carrier layer.

11. The doorbell device of claim 1 further comprising:

a circuit board, wherein the elastic component is disposed between the upper case and the circuit board, and the elastic component further comprises a second fastening protrusion surrounding the flexible-carrier layer, and the second fastening protrusion protrudes in a direction opposite to the first fastening protrusion, and the second fastening protrusion is secured to the circuit board via an interference fit.

12. The doorbell device of claim 1 further including:

a second adhesive layer being disposed between the first fastening protrusion and the annular trench.

13. The doorbell device of claim 1, wherein the elastic component comprises an elastic sidewall, and the elastic sidewall connects the flexible-carrier layer to the first fastening protrusion.

14. A doorbell device, comprising:

an upper case comprising an outer surface, a first annular-holding surface, a first opening, and an annular trench, wherein the first annular-holding surface is disposed opposite to the outer surface, and the first annular-holding surface surrounds the first opening, and the annular trench surrounds the first annular-holding surface and the first opening;

an elastic component comprising a first fastening protrusion, and a flexible-carrier layer, wherein the first fastening protrusion connects and surrounds the flexible-carrier layer; and a button module comprising a second annular-holding surface, a pressing surface, a protecting inner surface, an inner carrier surface, a first bottom surface, and a sensor, wherein the pressing surface is disposed opposite to the first bottom surface, the protecting inner surface is disposed opposite to the pressing surface, the inner carrier surface is disposed opposite to the first bottom surface, a space is formed between the protecting inner surface and the inner carrier surface, and the sensor is disposed in the space, wherein the first fastening protrusion of the elastic component is secured to the annular trench via an interference fit, and the button module is disposed on the flexible-carrier layer of the elastic component, and at least a part of the first bottom surface is facing the flexible-carrier layer, and part of the button module surrounded by the second annular-holding surface corresponds to the first opening, and the second annular-holding surface of the button module is facing the first annular-holding surface of the upper case.

* * * * *